US007244176B2

(12) United States Patent
Chang

(10) Patent No.: US 7,244,176 B2
(45) Date of Patent: Jul. 17, 2007

(54) OUTLET-ADJUSTING DEVICE OF COIN DISPENSER

(75) Inventor: Hung-Yi Chang, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 157 days.

(21) Appl. No.: 10/709,087

(22) Filed: Apr. 13, 2004

(65) Prior Publication Data

US 2005/0227604 A1 Oct. 13, 2005

(51) Int. Cl.
*G07D 1/00* (2006.01)

(52) U.S. Cl. ..... 453/18

(58) Field of Classification Search ..... 453/18, 453/24, 44, 50, 51, 52, 53, 54
See application file for complete search history.

(56) References Cited

U.S. PATENT DOCUMENTS 5,931,732 A * 8/1999 Abe et al. ..... 453/50
6,059,651 A * 5/2000 Abe et al. ..... 453/50
6,352,472 B1 * 3/2002 Tsuchida et al. ..... 453/50
6,695,689 B2 * 2/2004 Abe ..... 453/33

* cited by examiner

*Primary Examiner*—Patrick Mackey
*Assistant Examiner*—Mark J. Beauchaine

(57) ABSTRACT

An outlet-adjusting device suitable for a coin dispenser is provided. The outlet adjusting device comprises a directing element, an ejecting element and an positioning member, wherein the positioning member and the directing element are adapted for adjusting a biasing angle of a directing flange of the directing element so as to lead and dispense the coin from said coin outlet. Thus, the outlet-adjusting device allows the coin dispenser to dispense coins of various sizes.

17 Claims, 11 Drawing Sheets

OUTLET-ADJUSTING DEVICE OF COIN DISPENSER

BACKGROUND OF INVENTION

The present invention generally relates a coin dispenser, and more particularly to an outlet adjusting device suitable for a coin dispenser capable of dispensing coins of various sizes.

The coin dispenser is usually placed in an entertainment facility for providing dispensing coins as a convenience to users. Coins, such as fifty, ten, five or one dollars, are of different sizes and thickness, and also the tokens designed by the entertainment facility management are different of sizes and thickness. Accordingly, the coin dispenser needs to have the coin outlet of various specifications corresponding to various sizes of coins in order to dispense coins of various sizes. The conventional coin dispenser, as shown in FIG. 10, has a motor to turn the rotating plate A1 having a plurality of protrusions A2. There is a gap between every two adjacent protrusions A2. The inner and outer sides of the coin outlet A3 have a directing element A4 and a fine adjustment switch A5 installed respectively. The rotating plate A1 is adapted to rotate in a manner that the protrusions A2 push the coins within the coin collector A6 to the inner side of the coin outlet A3, and the coins can also be sent out of the coin outlet A3 by the pushing force of the protrusions A2 and as directed by the directing element A4. The fine adjustment switch A5 is activated as the coins contacts the fine adjustment switch A5 while passing through the coin outlet A3, and this can be adapted for counting the number of coins dispensed.

The above conventional structure of the coin dispenser has a fixed space for the coin outlet A3, which is not suitable for fitting coins of various sizes, and if the space of the coin outlet A3 is smaller than the dimension of the coin, the coin cannot be dispensed from the coin outlet A3. On the contrary, if the space of the coin outlet A3 is larger than the dimension of the coin, then the coin will bounce all around while being dispensed out. Therefore, for dispensing coins with different sizes, the vender has to design coin outlets with various specifications, consequently the cost of the machine will be substantially increased.

Another conventional coin dispenser shown in FIG. 11 comprises a frame, a coin collector, a rotating plate, a service motor, a dispensing plate, an ejecting mechanism, a resilient steel bead and so on. The coin dispenser allows the coin within the coin collector fall into the coin slot effectively to prevent rotating in idleness, as well as to reduce the chances of jamming the coins and accurately count the quantity of the coins dispensed. However, the above conventional coin dispenser also have several defects as described below.

The dispensing plate B1 has a plurality of arch-shape flanges B2, and every arch-shape flange B2 is formed according to the coin B3 with the certain specification, therefore, different size of the coin B3 requires a different dispensing plate B1 with specification corresponding to the particular coin B3. Thus, a coin dispenser requires a plurality of dispensing plate B1, which is obviously impractical in consideration of cost.

The gap B11 between the dispensing plate B1 and the ejecting mechanism B4 is fixed and cannot be adjusted, thus the size of the coin B3 must be of a certain size in order to pass through the gap B11 between the dispensing plate B1 and the ejecting mechanism B4.

The dispensing plate B1 has a resilient plate B5 supporting a side and the ejecting mechanism B4 is controlled by the spring B6. When the coin B3 positions against the arch-shape flange B2 of the dispensing plate B1 and the roller B7 of the ejecting mechanism B4, the top flange at the bottom surface of the rotating plate B8 requires additional force to overcome the rebounding force created by the dispensing plate B1 and the ejecting mechanism B4. Accordingly, the rotating plate B8 is under increased stress due to resistance during rotation.

Accordingly, a solution to resolve the above defects of the convention coin dispensers is an important subject for the manufacturers in the field.

SUMMARY OF INVENTION

Accordingly, in the view of the foregoing, the present inventor makes a detailed study of related art to evaluate and consider, and uses years of accumulated experience in this field, and through several experiments, to create a new coin dispenser capable of dispensing coins of various sizes. The present invention provides an innovated cost effective an outlet-adjusting device suitable for a coin dispenser for dispensing coins of various sizes.

According to an aspect of the present invention, the coin outlet of the coin dispenser comprises an outlet-adjusting device. The outlet-adjusting device comprises a directing element, an ejecting element and a sensor. The directing element comprises a directing flange at a side thereof, wherein the position of the directing flange can be adjusted in a manner to adjust a biasing angle of the directing flange according to a size of the coin and lead the coin to the coin outlet. Thus, the outlet-adjusting device of the present invention is capable of substantially adjusting the biasing angle of the directing flange according to a size of the coin allowing the coin dispenser to load and dispense coins of various sizes. On the other side of the coin outlet, the ejecting element is set in the adjusting groove to block the coin in the coin positioning hole formed on the rotating plate and the coins are ejected out of the coin outlet.

According to another aspect of the present invention, the directing element has a plurality of gearing members at a side thereof, and a positioning groove is formed on the positioning member of the coin outlet corresponding to the gearing members, so that the gearing members of the directing element can be positioned into the positioning groove of the positioning member for providing both angle adjustment of the directing flange and positioning functions.

According to another aspect of the present invention, a sensor is positioned at the other side apart from the coin outlet on the chassis for sensing the status of coin dispensing from the coin collector.

According to another aspect of the present invention, the coin outlet can optionally have a lid having an adjustment hole thereon on the adjusting device. The directing element of the outlet-adjusting device has an adjusting member protruding out from the adjustment hole of the lid.

BRIEF DESCRIPTION OF DRAWINGS

For a more complete understanding of the present invention, reference will now be made to the following detailed description of preferred embodiments taken in conjunction with the following accompanying drawings.

DETAILED DESCRIPTION

Figure 1:
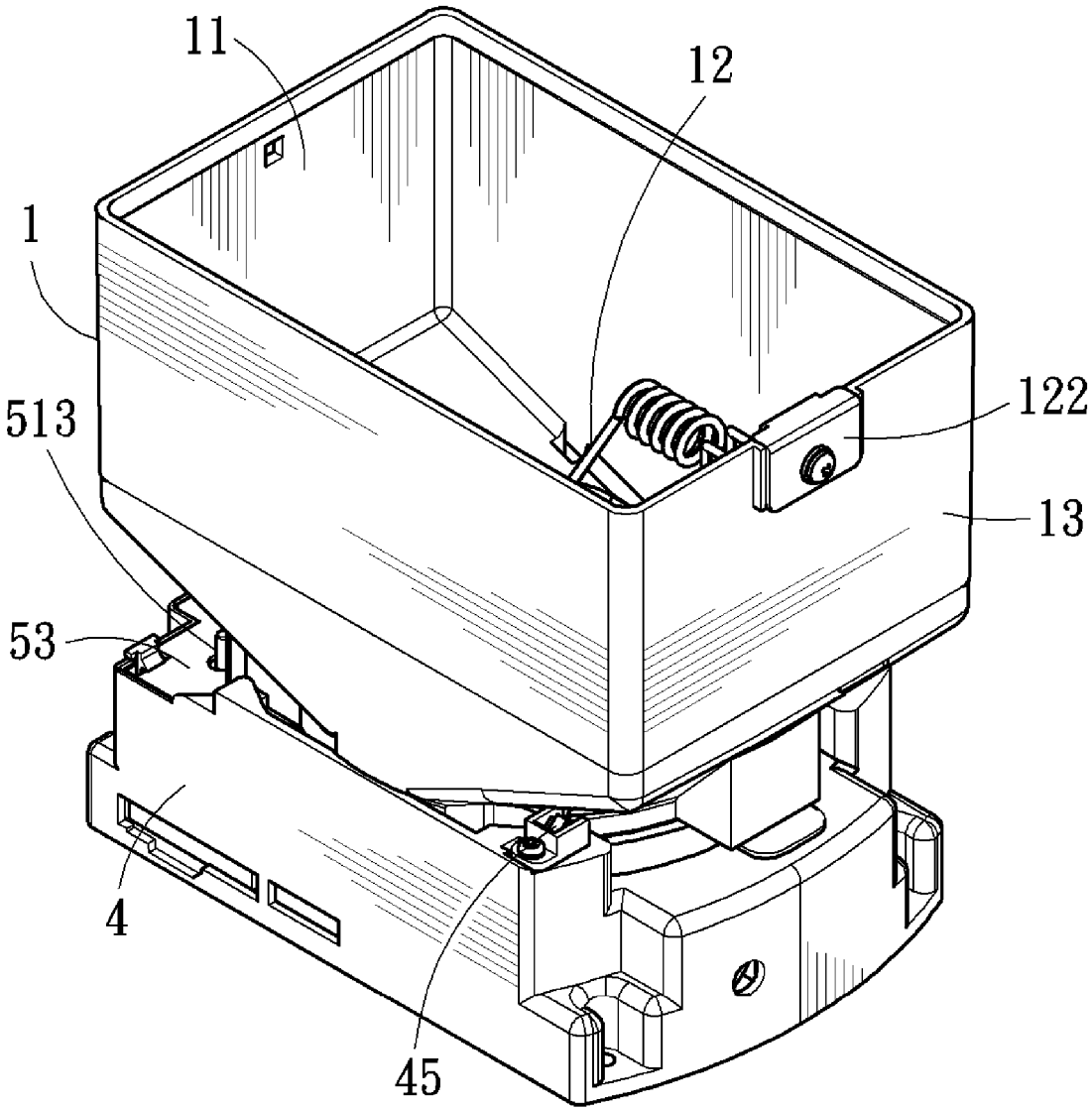
FIG. 1 is the elevational view of a coin dispenser according to an embodiment of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
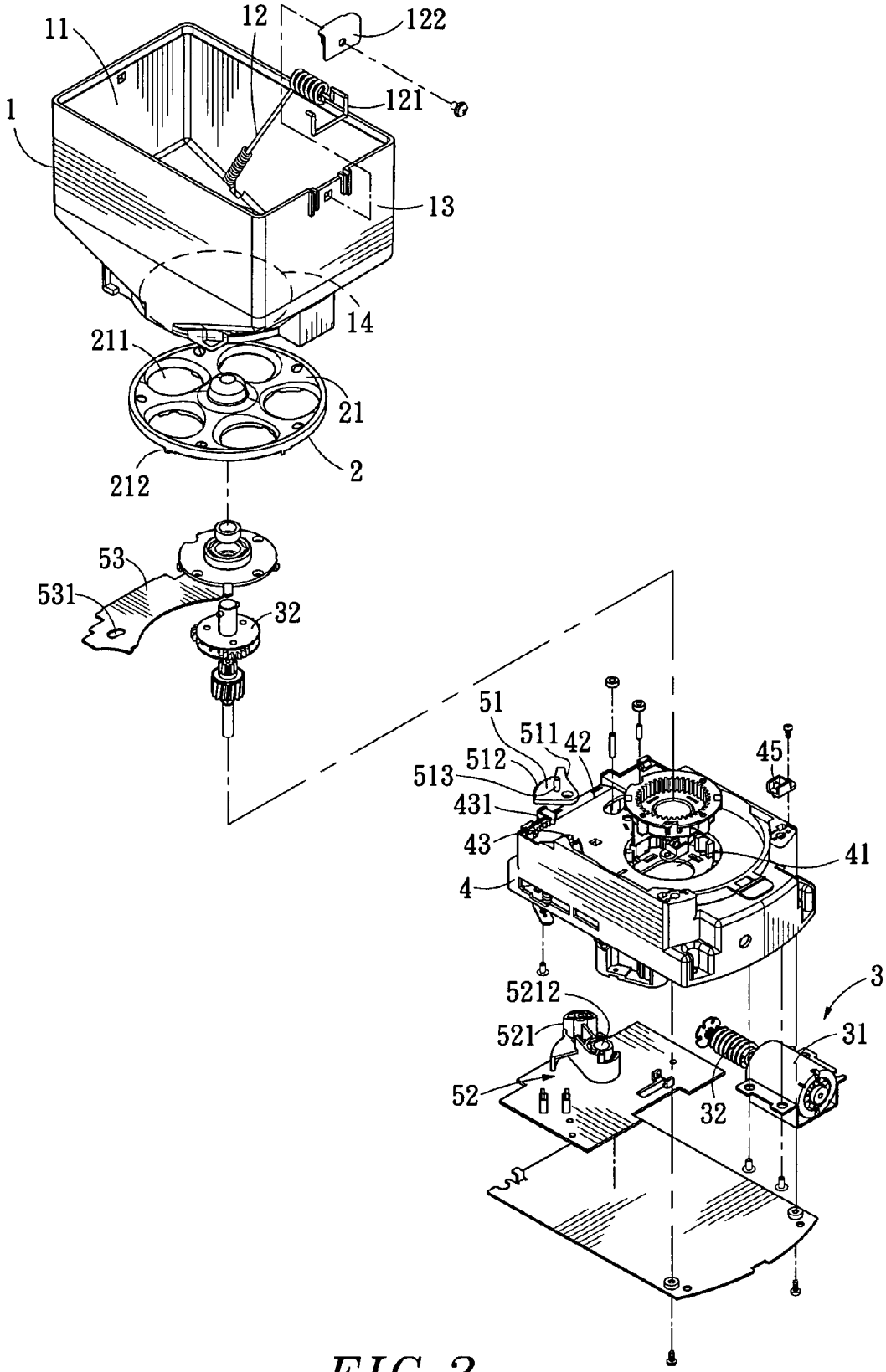
FIG. 2 is the exploded view of a coin dispenser according to an embodiment of the present invention.
Figure 3:
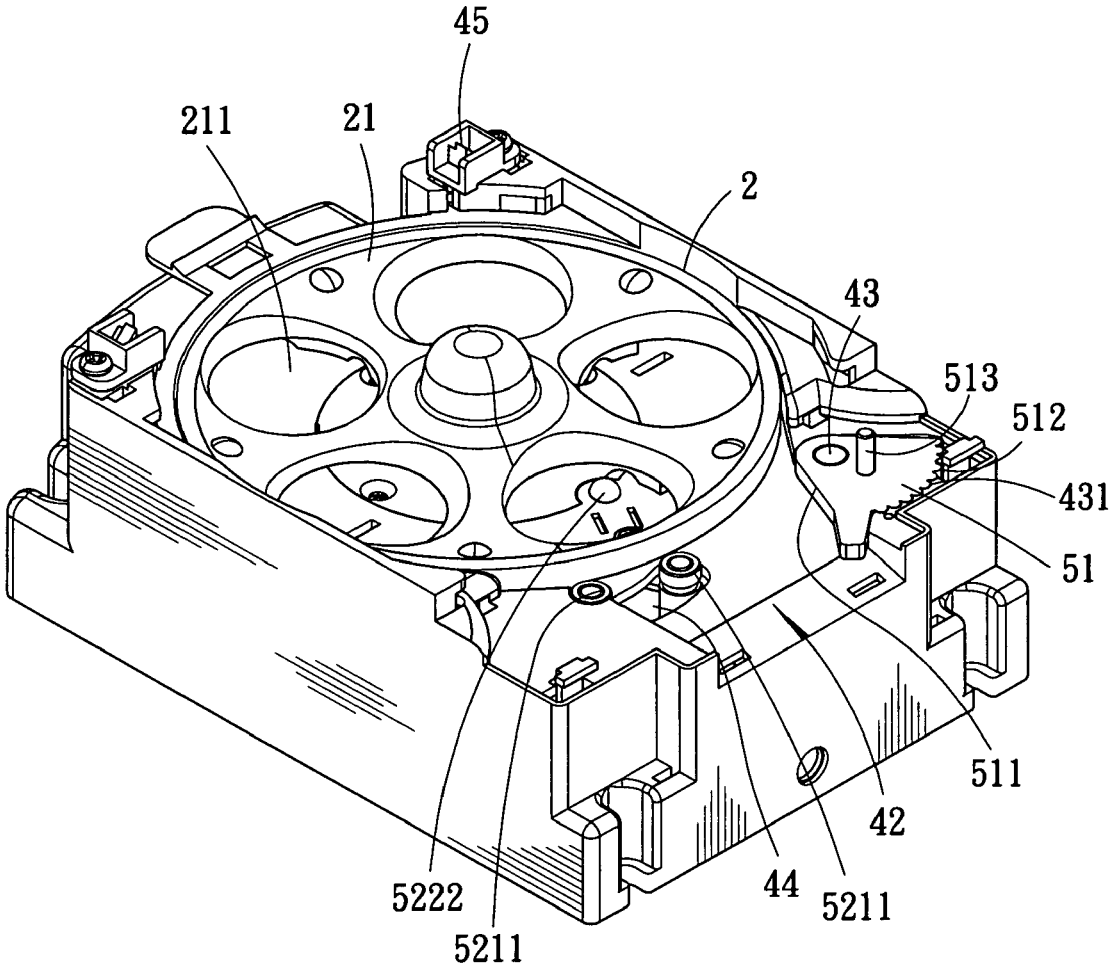
FIG. 3 is the elevational view of a chassis of the coin dispenser according to an embodiment of the present invention.
Figure 4:
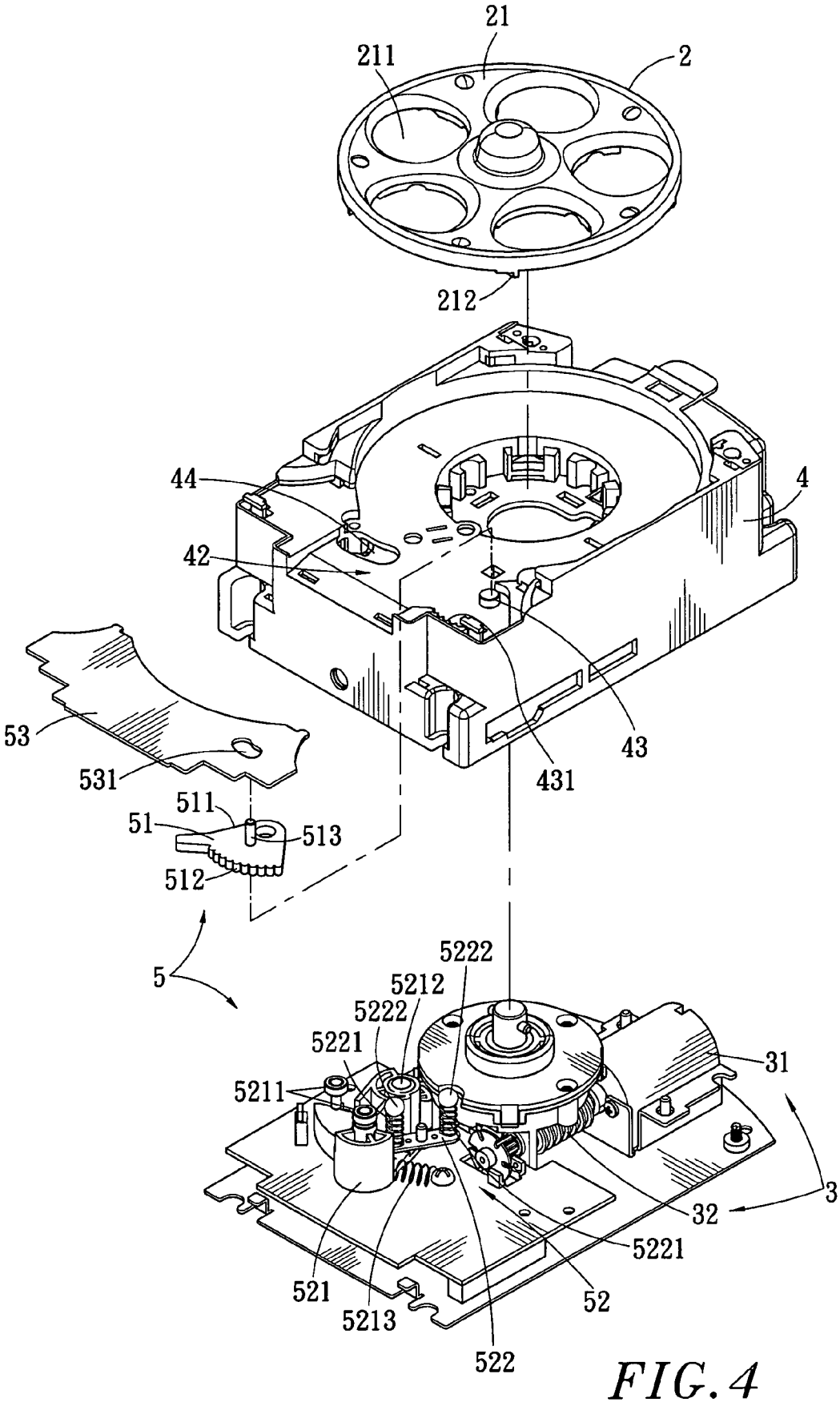
FIG. 4 is the exploded view of a chassis of the coin dispenser according to an embodiment of the present invention.
Figure 5:
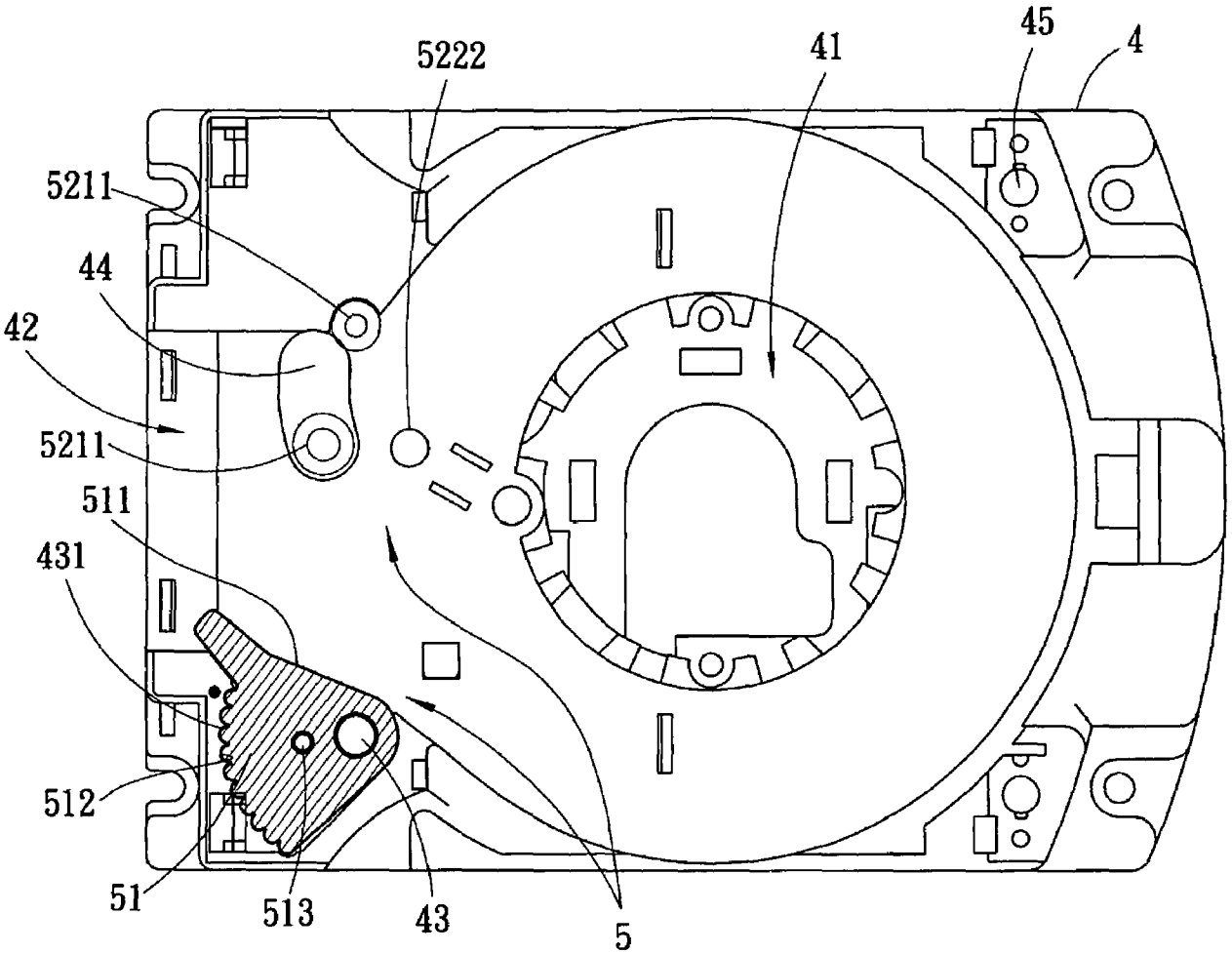
FIG. 5 is a top view showing before adjusting the position of the directing element of the coin dispenser according to an embodiment of the present invention.
Figure 6:
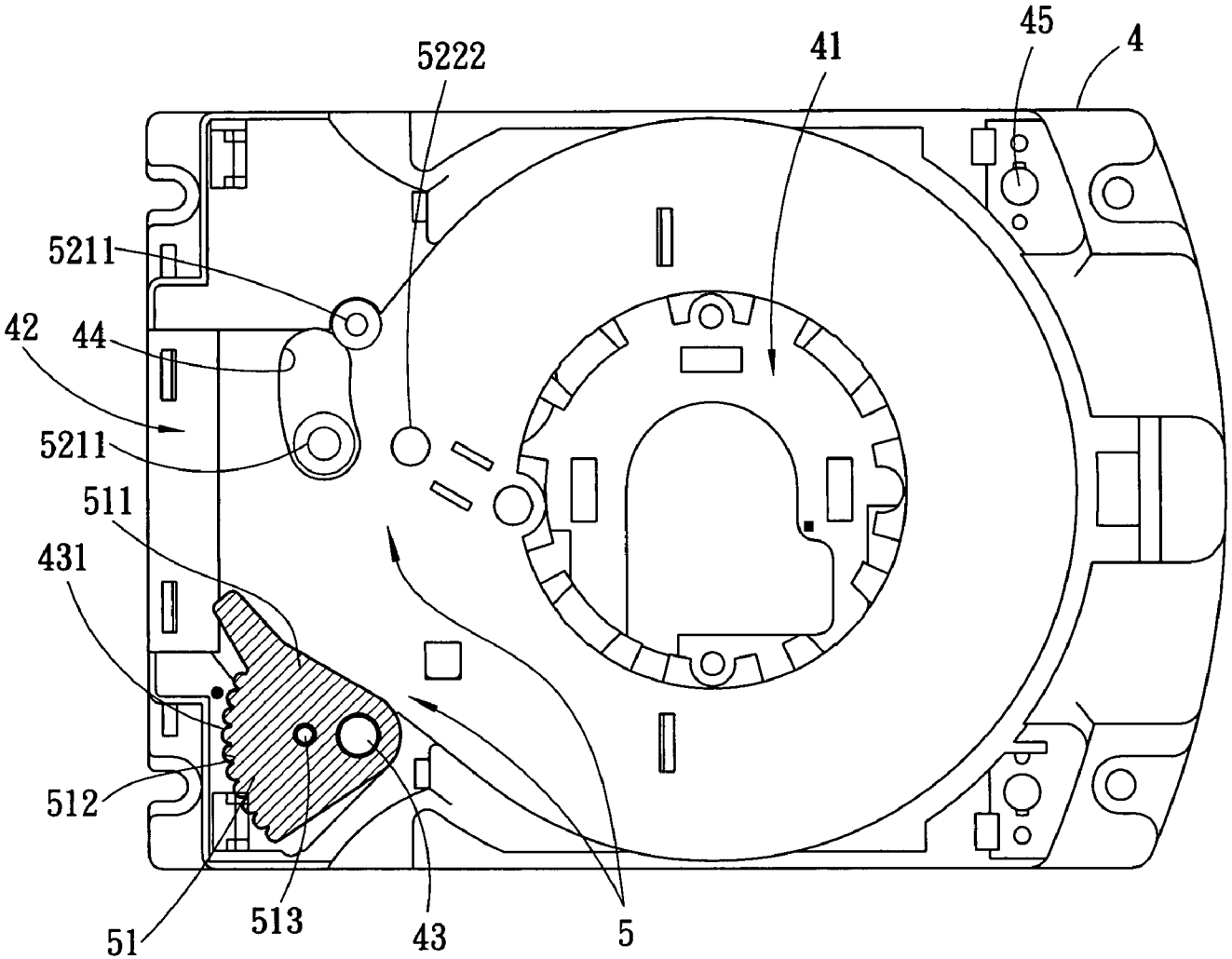
FIG. 6 is a top view showing when the directing element is biasing a sector according to an embodiment of the present invention.
Figure 7:
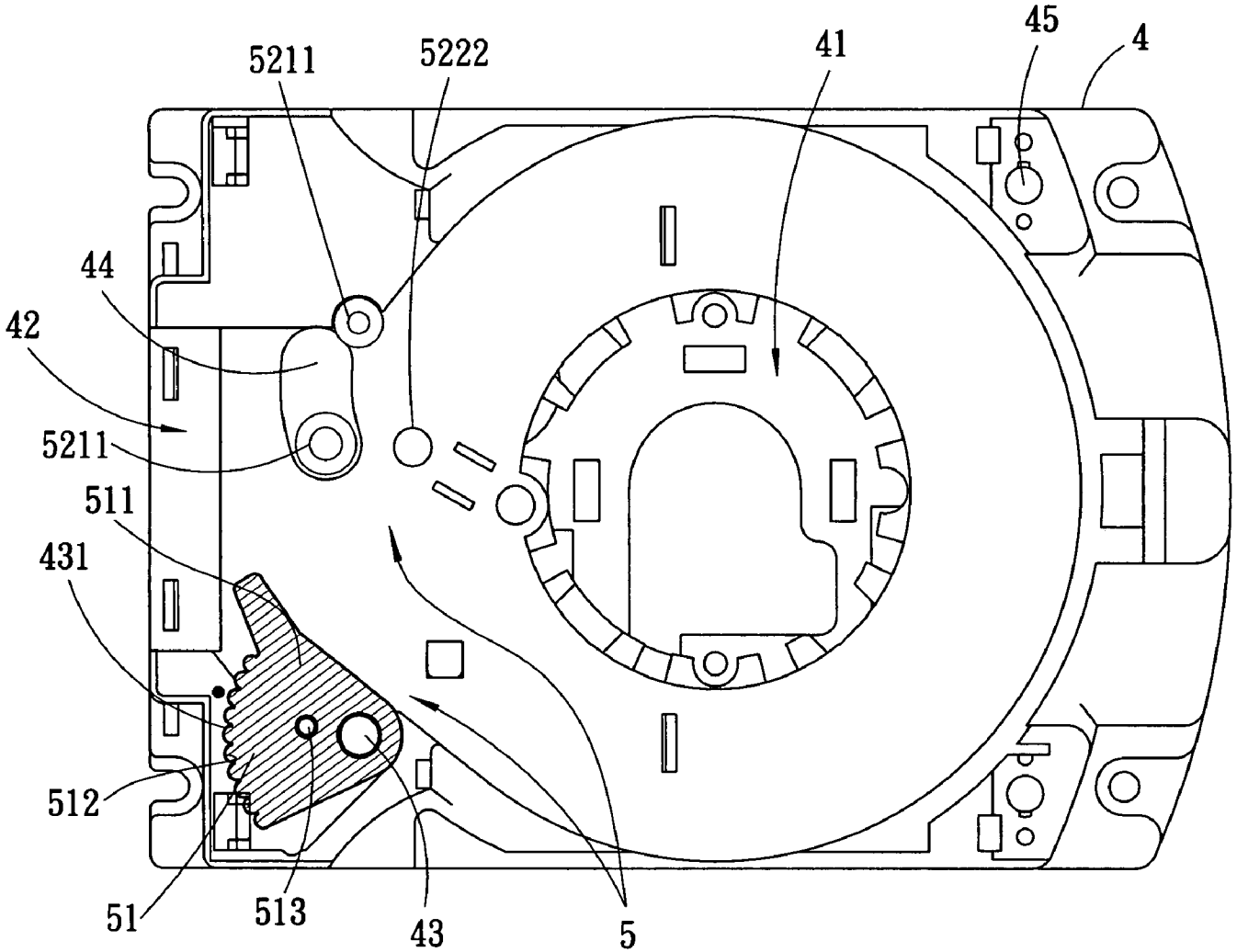
FIG. 7 is a top view showing when the directing element is biasing two sectors according to an embodiment of the present invention.
Figure 8:
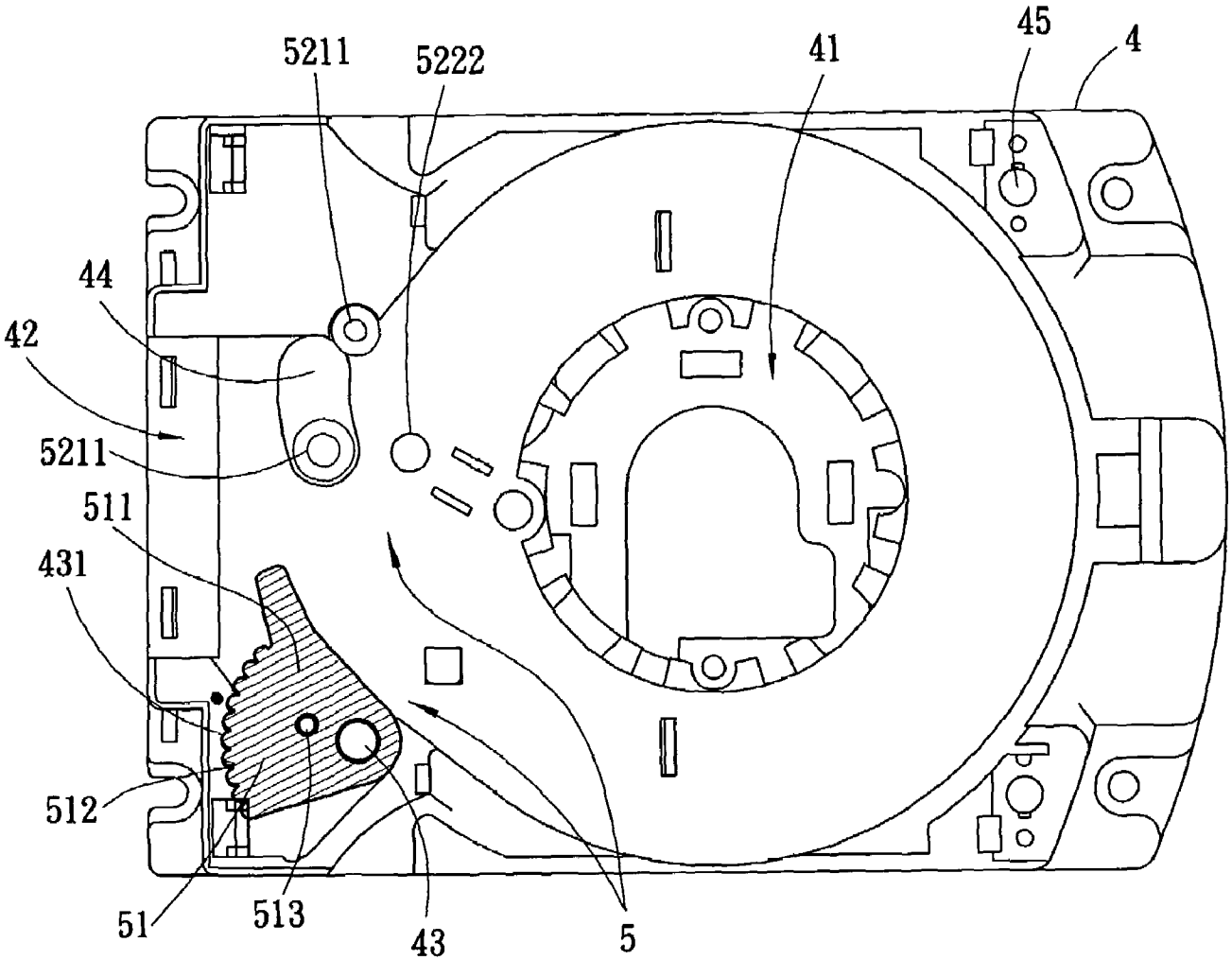
FIG. 8 is a top view showing when the directing element is biasing three sectors according to an embodiment of the present invention.
Figure 9:
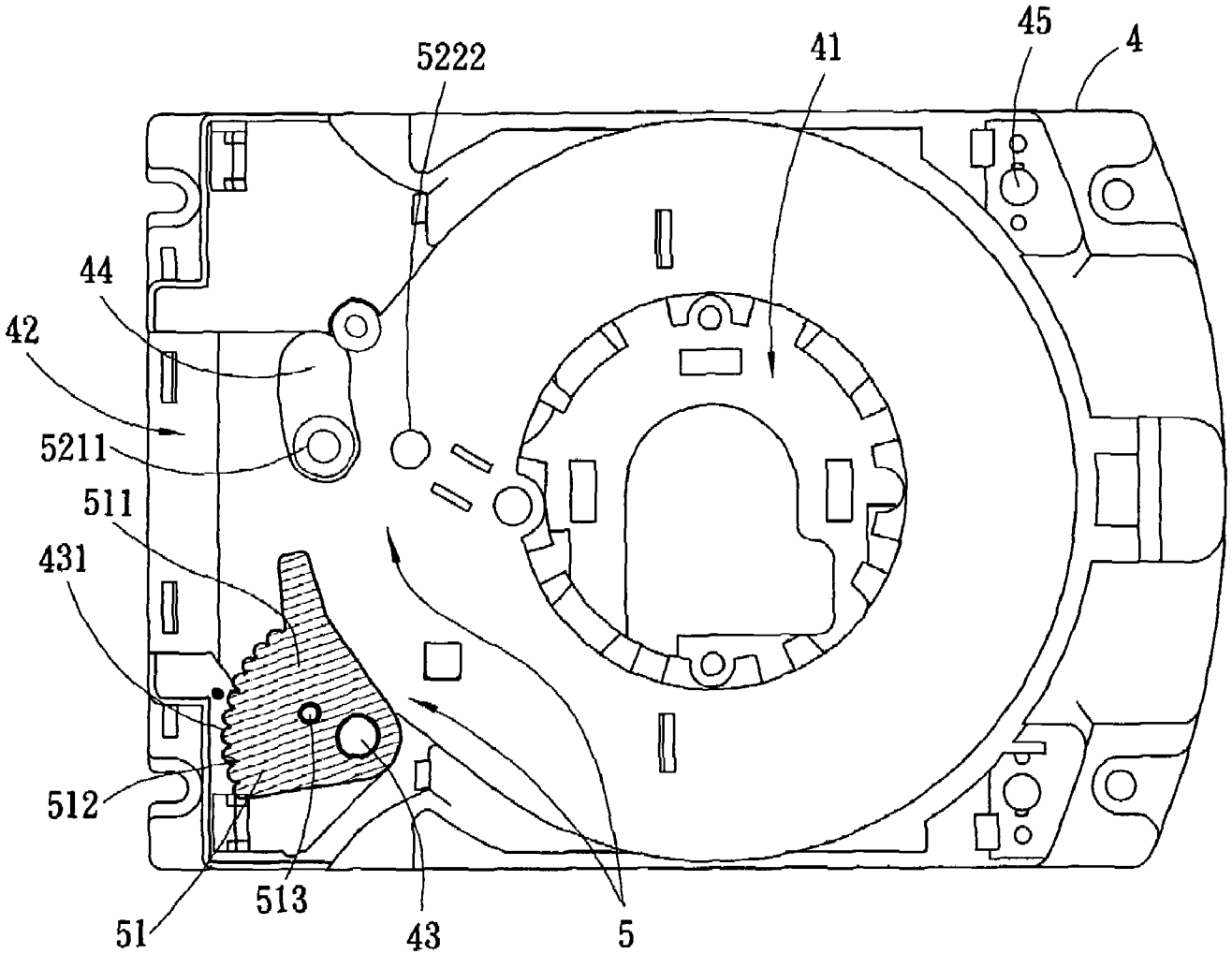
FIG. 9 is a top view showing when the directing element is biasing four sectors according to an embodiment of the present invention.
Figure 10:
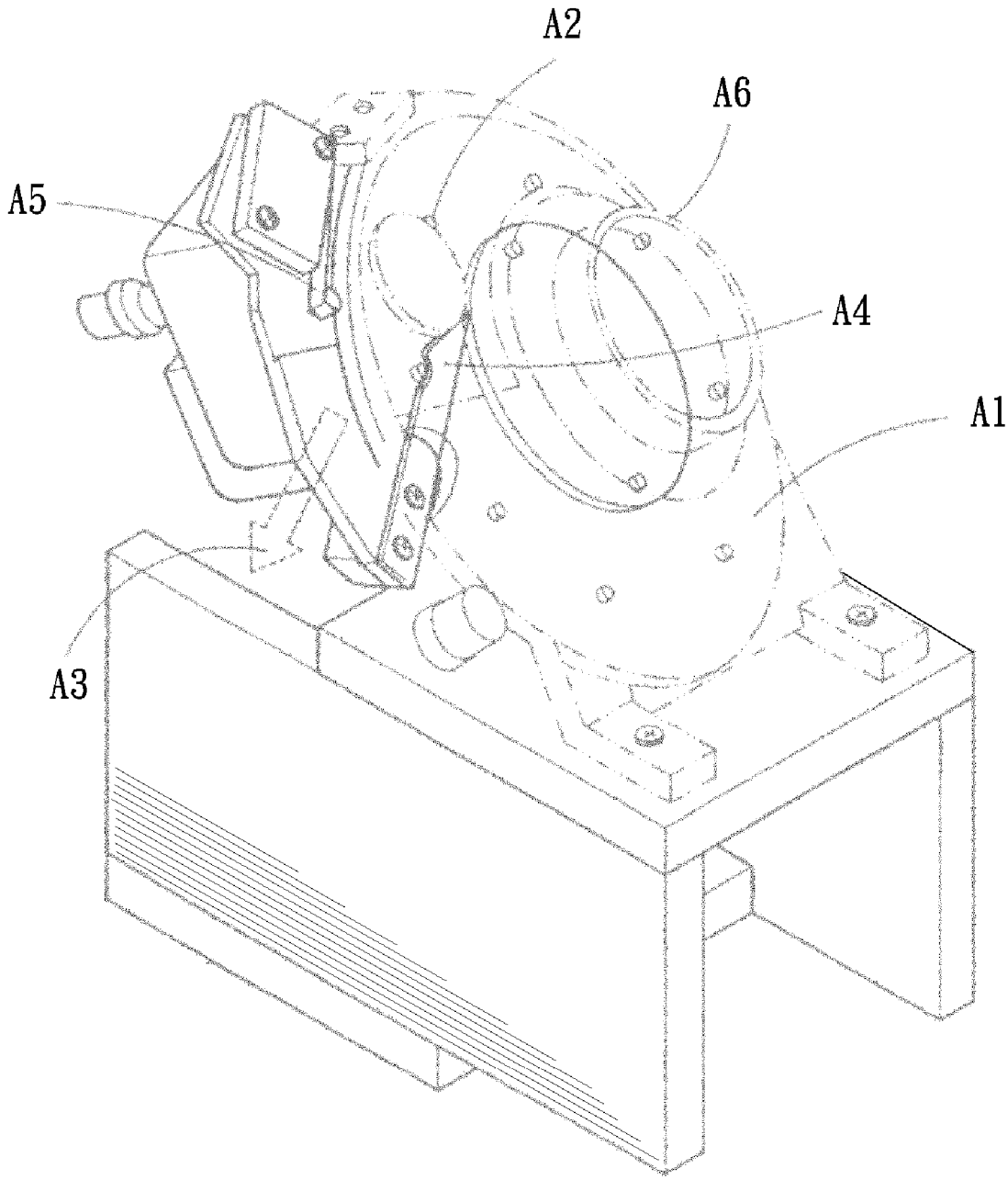
PRIOR ART FIG. 10
FIG. 10 is a view showing an elevational view of a conventional coin dispenser.
Figure 11:
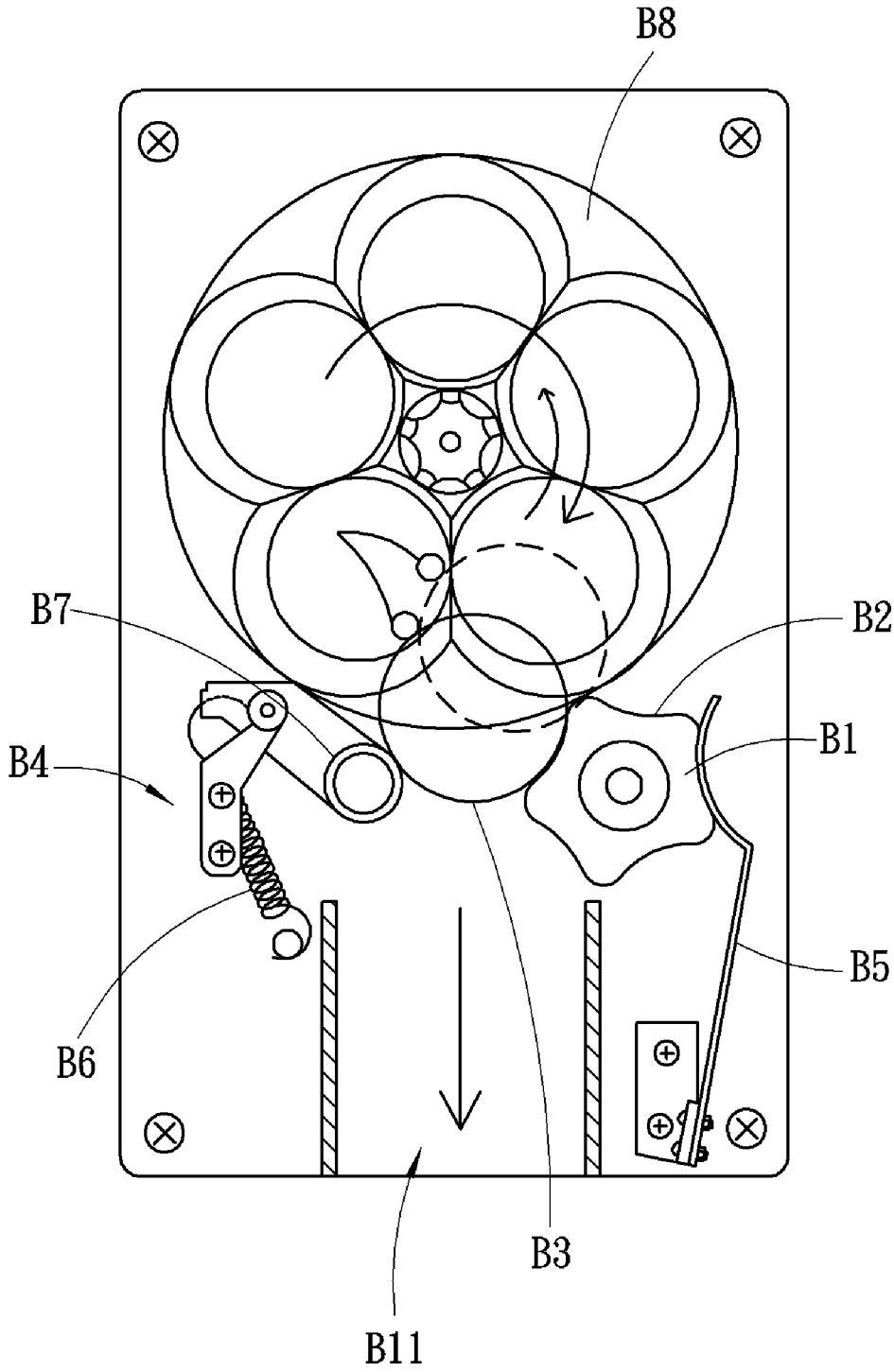
PRIOR ART FIG. 11
FIG. 11 is a top view showing another conventional coin dispenser.

Referring to FIGS. 1, 2 and 3, an elevational view, an exploded view, and an elevational view of a chassis of a coin dispenser according to an embodiment of the present invention are shown. The coin dispenser comprises a coin collector 1, a rotating plate 2, a motor device 3, a chassis 4 and an outlet-adjusting device 5.

The coin collector 1 is a box shaped structure. The coin collector 1 encloses a space 11 and a resilient element 12 set within the space 11. A positioning member 121 is disposed on a distal end of the resilient element 12, which is adapted for securely fixing to the sidewall 13 of the coin collector 1 via the securing element 122. Furthermore, the coin collector 1 comprises an outlet 14 at a bottom thereof communicating with the space 11 as shown in FIG. 2.

The rotating plate 2 is round shaped structure and has a plurality of coin positioning holes 211 on the top surface 21 thereof. A plurality of supporting elements 212 corresponding to every coin positioning hole 211 are formed protruding from the bottom surface of the rotating plate 2 opposite the top surface 21.

The motor device 3 comprises a motor 31 for driving the driving mechanism 32 for rotating, for example, the rotating plate 2.

The chassis 4 encloses an inner space 41 and comprises a coin outlet 42 formed on a top sidewall thereof. The coin outlet 42 has a positioning member 43 formed at a side thereof. The chassis 4 comprises a positioning member 43 having a plurality of positioning grooves 431. Further, an adjusting groove 44 is formed on another side thereof apart from the positioning member 43.

The outlet-adjusting device 5 has a directing element 51, an ejecting element 52 and a lid 53. The directing element 51 comprises a directing flange 511 on a side thereof and a plurality of gearing members 512 on another side thereof. The directing element 51 comprises an adjusting member 513 positioned on a top thereof. The ejecting element 52 comprises a rotating set 521 comprising two adjusting elements 5211 at a side thereof and an axial member 5212 on another side thereof, wherein one of the adjusting elements 5211 is secured to the chassis 4 and the other adjusting element 5211 is moveable in the adjusting groove 44, and wherein the rotating set 521 is rotated by the axial member 5212. The rotating set 521 comprises a resilient element 5213, for example a spring, on a bottom thereof, which is adapted for applying a tension for restoring the position of the rotating set 521. A rotating member 522, is rotationally set on the rotating set 521. The rotating member 522 comprises a plurality of resilient members 5221, each of the resilient members 5221 has a stop member 5222 formed thereon. Furthermore, the lid 53 is disposed covering a top of the directing element 51 and the ejecting element 52. The lid 53 comprises an adjusting hole 531.

The directing element 51 of the outlet-adjusting device 5 can be biased to a suitable position in the positioning member 43 according to the size of the dispensing coin. Accordingly, the coin outlet 42 of the chassis 4 is capable of dispensing coins of various sizes. The rotating plate 2 is positioned axially within the outlet 14 at the bottom of the space 11 of the coin collector 1. The bottom of the rotating plate 2 is jointed to the driving mechanism 32 of the motor device 3. The motor 31 is adapted for activating the driving mechanism 32 for rotating the rotating plate 2 within the outlet 14. When the coin enters into the space 11 of the coin collector 1, the rotating plate 2 positioned within the outlet 14 starts to rotate to roll the coins stored within the space 11. Thereafter, the resilient element 12 begins to stir the coins to facilitate the coins to fall one by one into the coin positioning holes 211 of the rotating plate 2. Meanwhile, the supporting element 212 positioned under the rotating plate 2 pushes the coin towards the coin outlet 42 so that the supporting element 212 of the rotating plate 2 spins out the coins under the gravitational force and thus the coins are dispensed.

The chassis 4 comprises a sensor 45 positioned at the side thereof apart from the coin outlet 42 for detecting the status of dispensing coins.

Referring to FIGS. 3, 4, 5 and 6, before dispensing the coin, the directing element 51 of the outlet-adjusting device 5 on the chassis 4 is capable of adjusting the biasing angle of the directing flange 511 according to the size of the coin by pulling the adjustment member 513 protruding from the adjusting hole 531 of the lid 53 to release the directing element 51 from the positioning member 43 to adjust the angle of the directing flange 511 of the directing member 5 so as to lead the coin towards the coin outlet 42, and the directing element 51 is positioned back into the positioning member 43 and the gearing member 512 of the directing element 51 is positioned into the positioning groove 431 of the positioning member 43 as shown in FIGS. 6, 7, 8 and 9. And, when the rotating plate 2 pushes the coin towards the coin outlet 42, the rotating plate 2 spins out the coin under the gravitational force whereby the coin bumps the directing flange 511 of the directing element 51 and the coin is dispensed out of the coin outlet 42. Thus, the directing flange 511 can be adapted for leading the coin out of the coin outlet 42.

As the rotating plate 2 rotates, the supporting element 212 positioned at the bottom surface of the rotating plate 2 pushes the coin towards the coin outlet 42. Before the coin is dispensed out of the coin outlet 42, the coin touches the stop members 5222 of the ejecting element 52, and as the coin comes in contact with the stop members 5222, the advancing force of the coin depress the stop members 5222, and the elastic force of the stop members 5222 due to the resilient members 5221 pushes the coin towards the moveable adjusting elements 5211 and as the coin comes in contact with the moveable adjusting element 5211, the advancing force of the coin pushes the moveable adjusting elements 5211 positioned in the adjusting groove 44 so that the moveable adjusting element 5211 moves within the adjusting groove 44 of the chassis 4 and thereby pulls the resilient element 5213 and creates a tension on the resilient element 5213. And, the tension on the resilient element 5213 restores the movable adjusting element 5211 to its original position by rotating about the axial member 5212 of the rotating set 521 due to the elasticity of the resilient member 5213, and the restoration force of the adjusting element 5211 ejects the coin out from the coin outlet 42.

The coin dispenser of the present invention has at least the following advantages.

1. The directing element, the adjusting member and stop member of the outlet-adjusting device are adapted for pushing the coin towards the coin outlet. Further, the position of the biasing angle of the directing flange of the directing element can be adjusted according to the various sizes of the coins without altering any element or component of the coin dispenser.
2. The outlet-adjusting device is capable of adjusting the direction for dispensing the coin from the coin outlet in order to allow various sizes of coins to pass through.
3. The rotating plate pushes the coin towards the coin outlet and if the coin is blocked by the ejecting element, the elasticity of the resilient element of the rotating set positioned beneath the ejecting element is capable of pushing the coin towards the coin outlet. Thus, the coin can be released from the rotating plate without any resistance.
4. The chassis comprises the sensor positioned at the side thereof apart from the coin outlet for detecting the status of dispensing coins from the coin collector positioned above the chassis.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and nonlimiting sense.

The invention claimed is:

1. An outlet-adjusting device of a coin dispenser, comprising:

a directing element comprising a directing flange; and an ejecting element, wherein a position of said directing flange of said directing element can be adjusted according to a size of a coin so as to lead said coin and dispense said coin from a coin outlet, wherein said ejecting element comprises a rotating set having a plurality of adjusting elements and a rotating member, and wherein said rotating member comprises a plurality of resilient members and each of said resilient members comprises a stop member.

2. The outlet-adjusting device of a coin dispenser as claimed in claim 1, wherein said directing element comprises an adjusting member.

3. The outlet-adjusting device of a coin dispenser as claimed in claim 1, wherein said directing element comprises a plurality of gearing members positioned at a side thereof apart from said directing flange.

4. The outlet-adjusting device of a coin dispenser as claimed in claim 1, further comprising a positioning member having a plurality of positioning grooves at a side thereof.

5. The outlet-adjusting device of a coin dispenser as claimed in claim 1, wherein said stop member of said resilient member comprises a steel bead.

6. The outlet-adjusting device of a coin dispenser as claimed in claim 1, wherein said stop member of said resilient member comprises a metallic sphere.

7. The outlet-adjusting device of a coin dispenser as claimed in claim 1, wherein said outlet-adjusting device comprises a lid having an adjusting hole.

8. The outlet-adjusting device of a coin dispenser as claimed in claim 1, further comprising a chassis having a sensor at a side apart from said coin outlet for detecting a status of releasing coins.

9. A coin dispenser with an outlet-adjusting device, comprising:

a coin collector, enclosing a space and having an outlet at a bottom thereof communicating with said space;

a rotating plate, comprising a plurality of coin positioning holes, disposed within said outlet, wherein a gap is set between said coin positioning holes;

a chassis, disposed below the coin collector, wherein the chassis comprises a positioning member, an adjusting groove and a coin outlet positioned on a top sidewall of the chassis, said positioning member is positioned at a side of said chassis apart from said adjusting groove;

a motor device, set within said chassis below said rotating plate; and an outlet-adjusting device, having a directing element and an ejecting element, wherein said ejecting element protrudes through said adjusting groove, and wherein said positioning member and said directing element are adapted for adjusting a position of a directing flange of said directing element according to a size of a coin so as to lead said coin and dispense said coin from said coin outlet.

10. The coin dispenser with an outlet-adjusting device as claimed in claim 9, wherein said directing element comprises an adjusting member.

11. The coin dispenser with an outlet-adjusting device as claimed in claim 9, wherein said directing element comprises a plurality of gearing members positioned at a side thereof apart from said directing flange.

12. The coin dispenser with an outlet-adjusting device as claimed in claim 9, wherein said positioning member of said coin outlet comprises a plurality of positioning grooves at a side thereof.

13. The coin dispenser with an outlet-adjusting device as claimed in claim 9, wherein said ejecting element comprises a rotating set having a plurality of adjusting elements and a rotating member, and wherein said rotating member comprises a plurality of resilient members and each of said resilient members comprises a stop member.

14. The coin dispenser with an outlet-adjusting device as claimed in claim 13, wherein said stop member of said resilient members comprises a steel bead.

15. The coin dispenser with an outlet-adjusting device as claimed in claim 13, wherein said stop member of said resilient members comprises a metallic sphere.

16. The coin dispenser with an outlet-adjusting device as claimed in claim 9, wherein said outlet-adjusting device comprises a lid having an adjusting hole.

17. The coin dispenser with an outlet-adjusting device as claimed in claim 9, wherein said chassis has a sensor at a side apart from said coin outlet for detecting a status of releasing coins.

* * * * *